US009069309B2

(12) United States Patent
Kondo

(10) Patent No.: US 9,069,309 B2
(45) Date of Patent: Jun. 30, 2015

(54) FIXING DEVICE

(71) Applicant: Tomohiro Kondo, Nagoya (JP)

(72) Inventor: Tomohiro Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/171,915

(22) Filed: Feb. 4, 2014

(65) Prior Publication Data

US 2014/0294460 A1 Oct. 2, 2014

(30) Foreign Application Priority Data

Mar. 29, 2013 (JP) ..... 2013-071966

(51) Int. Cl.
*G03G 15/20* (2006.01)

(52) U.S. Cl.
CPC ..... *G03G 15/206* (2013.01)

(58) Field of Classification Search
USPC ..... 399/38, 69, 122, 320, 328, 329
See application file for complete search history.

(56) References Cited

U.S. PATENT DOCUMENTS 5,812,906 A * 9/1998 Staudenmayer et al. ..... 399/69
7,113,716 B2 9/2006 Tomatsu
8,208,833 B2 * 6/2012 Kitagawa ..... 399/122
8,463,150 B2 6/2013 Yoshikawa
2004/0234290 A1 11/2004 Tomatsu
2010/0272458 A1 10/2010 Yoshikawa

FOREIGN PATENT DOCUMENTS

JP 60-151681 * 8/1985
JP 62-014675 A 1/1987
JP 02-222980 * 9/1990
JP 2004-279702 A 10/2004
JP 2007-155848 A 6/2007
JP 2010-256696 A 11/2010

OTHER PUBLICATIONS

U.S. Appl. No. 14/171,902, filed Feb. 4, 2014.

* cited by examiner

*Primary Examiner* — Hoan Tran
(74) *Attorney, Agent, or Firm* — Banner & Witcoff, Ltd.

(57) ABSTRACT

A fixing device that includes a heater, a first endless belt, a first roller, and a second roller is provided. The first endless belt confronts the heater at a confronting part and providing a nip region upon contacting the heater. The first endless belt is movable in a first direction at the confronting part, and has an inner peripheral surface. The first roller supports the inner peripheral surface, and nips the first endless belt in cooperation with the heater. The nip region has a part facing the first roller. The second roller is disposed downstream of the nip region in the first direction and supports the inner peripheral surface. The second roller is positioned such that a part of the endless belt mounted over the second roller is out of contact from the heater.

26 Claims, 7 Drawing Sheets

PRIOR ART

FIXING DEVICE

CROSS REFERENCE TO RELATED APPLICATION

This application claims priority from Japanese Patent Application No. 2013-071966 filed Mar. 29, 2013. The entire content of the priority application is incorporated herein by reference.

TECHNICAL FIELD

The present invention relates to a fixing device that thermally fixes a transferred developing agent image to a sheet.

BACKGROUND

Japanese Patent Application Publication No. 2010-256696 discloses a fixing device including a heater, and a pressure belt providing a nip region in cooperation with the heater. The pressure belt is applied with a tension by a plurality of rollers. A pressure pad is disposed on an inner side of the pressure belt and at a portion where no roller is disposed in such a way that the nip region is provided between the heater and the pressure pad. Accordingly, an enlarged the nip region can be provided, and a portion of the heater that is in contact with a sheet can have an enlarged width, leading to an improvement in heating efficiency in the fixing device.

SUMMARY

In the nip region, if the contact pressure between the pressure belt and the heater is insufficient, sheet slippage relative to the pressure belt may occur at an entry position of the nip region. Therefore, an increase in contact pressure between the pressure belt and the heater is required.

However, according to the conventional fixing device, large pressing force is applied to the pressure belt due to the broad pressing area by the pressure pad. Therefore, if increase in contact pressure between the pressure belt and the heater at the entry position of the nip region is contemplated to prevent the sheet from being slipped at the entry position, the pressing force to be applied to the entire nip region must also be increased. As a result, the entire fixing device is subjected to larger load, which renders the structure of the fixing device more complex.

Therefore, the object of the present invention is to provide a fixing device with a simple structure yet capable of avoiding a failure of sheet conveyance at the entry position of the nip region.

In order to attain the above and other objects, the present invention provides a fixing device that includes a heater, a first endless belt, a first roller, and a second roller. The first endless belt confronts the heater at a confronting part and provides a nip region upon contacting the heater. The first endless belt is movable in a first direction at the confronting part, and has an inner peripheral surface. The first roller supports the inner peripheral surface, and nips the first endless belt in cooperation with the heater. The nip region has a part facing the first roller. The second roller is disposed downstream of the nip region in the first direction and supports the inner peripheral surface. The second roller is positioned such that a part of the endless belt mounted over the second roller is out of contact from the heater.

In another aspect of the invention, there is provided a fixing device including a first roller, a second roller, an endless belt, and a heater. The endless belt is arranged around the first roller and the second roller. The heater is configured to nip the endless belt in cooperation with the first roller, and to provide a nip region upon contacting the endless belt. The width of the nip region in a direction from the first roller toward the second roller is narrower than the distance between the first roller and the second roller.

DETAILED DESCRIPTION

Figure 1:
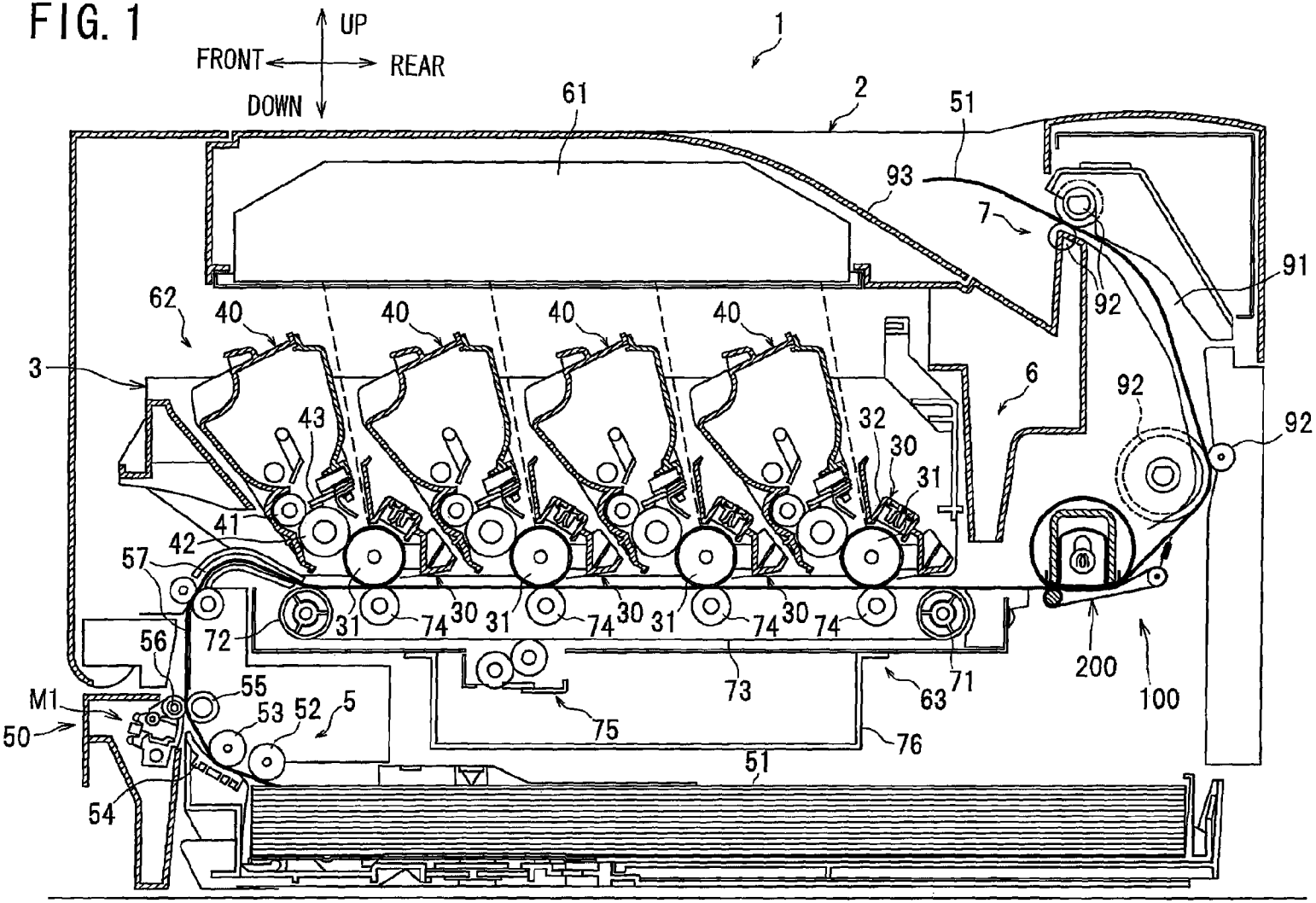
FIG. 1 is a schematic cross-sectional view showing a structure of a color laser printer having a fixing device according to one embodiment of the present invention.

A fixing device according to an embodiment of the present invention will be described in detail with reference to the accompanying drawings. As shown in FIG. 1, the color laser printer 1 includes a main frame 2, a sheet supplying unit 5 for supplying a sheet 51 as a recording medium, an image forming unit 6 for forming an image on the sheet 51, and a sheet discharge unit 7 for discharging a sheet on which an image has been formed.

Incidentally, in the following description, unless otherwise stated, the vertical direction of FIG. 1 is referred to as a vertical direction; the left side of FIG. 1 is referred to as front, and the right side as rear; and the back side of the paper surface is referred to as left, and the front side of the paper surface as right. In this manner, each of the directions is indicated. In this case, the left and the right are defined based on the directions in which a person standing in front of a color laser printer 1 is viewing.

<General Structure of Laser Printer>

The sheet supplying unit 5 includes a sheet supply tray 50 and a sheet supplying mechanism M1. The sheet supply tray 50 is mounted in the main frame 2 and is detachable from the main frame 2 at a front side thereof by a sliding operation. The sheet supplying mechanism M1 is configured for lifting the sheets 51 from a front side of the sheet supply tray 50 in a diagonally upward and frontward direction and then reversing the sheet 51 rearward.

The sheet supplying mechanism M1 is disposed near the front end portion of the sheet supply tray 50, and includes a pick-up roller 52, a separation roller 53, a separation pad 54, a paper dust removing roller 55, and a pinch roller 56. A conveying path 57 is provided above the sheet supplying mechanism M1, and a conveyer belt 73 is provided above the sheet supply tray 50 and downstream of the conveying path 57.

An uppermost sheet 51 of a sheet stack on the sheet supply tray 50 is separated in an upward direction through cooperative operation of the pick-up roller 52, the separation roller 53, and the separation pad 54. As the sheet 51 fed in the upward direction passes between the paper dust removing roller 55 and the pinch roller 56, paper dust is removed from the sheet 51. Then, the sheet 51 is conveyed along the conveying path 57 while the conveying direction of the sheet 51 is changed to a rearward direction. Subsequently, the sheet 51 is conveyed onto the conveyor belt 73.

The image forming unit 6 includes a scanning unit 61, a process unit 62, a transfer unit 63, and a fixing device 100.

The scanning unit 61 is disposed in an upper section of the main frame 2, and includes four sub-scanning units each corresponding to one of four colors cyan, magenta, yellow, and black. Although not shown in the drawings, each of the sub-scanning units includes a laser emitting section, a polygon mirror, a plurality of lenses, and a reflecting mirror. The laser emitting section emits a laser beam, which is scanned at a high speed by the polygon mirror in the left-to-right direction and passes through and is reflected by the plurality of lenses and the reflecting mirror so as to irradiate a surface of a corresponding photosensitive drum 31 described later.

The process unit 62 is disposed below the scanning unit 61 and above the sheet supplying unit 5, and includes a drum unit 3. The drum unit 3 has four sub-drum units 30 and four developing cartridges 40 corresponding to the sub-drum units 30.

Each sub-drum unit 30 includes the photosensitive drum 31 and a scorotron charger 32. Each developing cartridge 40 includes a toner supply roller 41, a developing roller 42, and a doctor blade (toner layer thickness regulation blade) 43, and accommodates therein toner of specific color.

During the image forming operation, the toner in the developing cartridges 40 is supplied to the developing roller 42 via the toner supply roller 41. In this case, the toner is charged with a positive polarity by triboelectric charging. The toner conveyed on the developing roller 42 becomes a thin layer having a uniform thickness by the doctor blade 43 in accordance with the rotation of the developing roller 42.

In the sub-drum units 30, the surface of the photosensitive drum 31 is uniformly charged with a positive polarity by the scorotron charger 32, Then, the surface is subjected to high speed scan of the laser beam from the scanning unit 61 based on the image data. Thus, an electrostatic latent image is formed on the surface of the photosensitive drum 31.

The developing roller 42 supplies the toner onto the electrostatic latent image on the rotating photosensitive drum 31; the latent image has been formed by the discharge of the positively charged surface as a result of the exposure to the laser beam. Thus, the reversal development process is carried out in which the photosensitive drum 31 obtains a visible toner image formed of each color of the toner; in other words, the electrostatic latent image is converted into a toner color image.

The transfer unit 63 includes a drive roller 71, a driven roller 72, the conveyor belt 73, a plurality of transfer rollers 74, and a cleaning unit 75. The drive roller 71 and the driven roller 72 are disposed in parallel with and separated from each other. The conveyor belt 73 is an endless belt disposed over the drive roller 71 and the driven roller 72. An outer surface of the conveyor belt 73 serves as a conveying surface and contacts each of the photosensitive drums 31. The transfer rollers 74 are disposed in opposition to the corresponding photosensitive drums 31 via the conveyor belt 73, and are applied with transfer bias from a high-voltage circuit board (not shown). During the image forming operation, the conveyor belt 73 conveys the sheet. Subsequently, the sheet 51 conveyed by the conveyor belt 73 is nipped between the photosensitive drum 31 and the transfer roller 74 via the conveyor belt 73, whereby a toner image is transferred from the photosensitive drum 31 onto the sheet 51.

The cleaning unit 75 is disposed below the conveyor belt 73 for removing toner adhered to the conveyor belt 73. A toner accumulation section 76 is disposed below the cleaning unit 75 for accumulating toner removed by the cleaning unit 75.

The fixing device 100 is disposed rearward of the transfer unit 63. The toner image transferred onto the sheet 51 is thermally fixed thereon as the sheet 51 passes through the fixing device 100.

In the sheet discharge unit 7, a paper-discharge-side conveying path 91 is so formed as to extend upward from an outlet of the fixing device 100 and to make a turn to the front side. A plurality of conveying rollers 92 for conveying the sheet 51 is disposed on the paper-discharge-side conveying path 91. A discharge tray 93 is provided on the upper surface of the main frame 2 for accommodating the sheet 51 discharged from the paper-discharge-side conveying path 91.

<Detailed Configuration of Fixing Device>

Figure 2A:
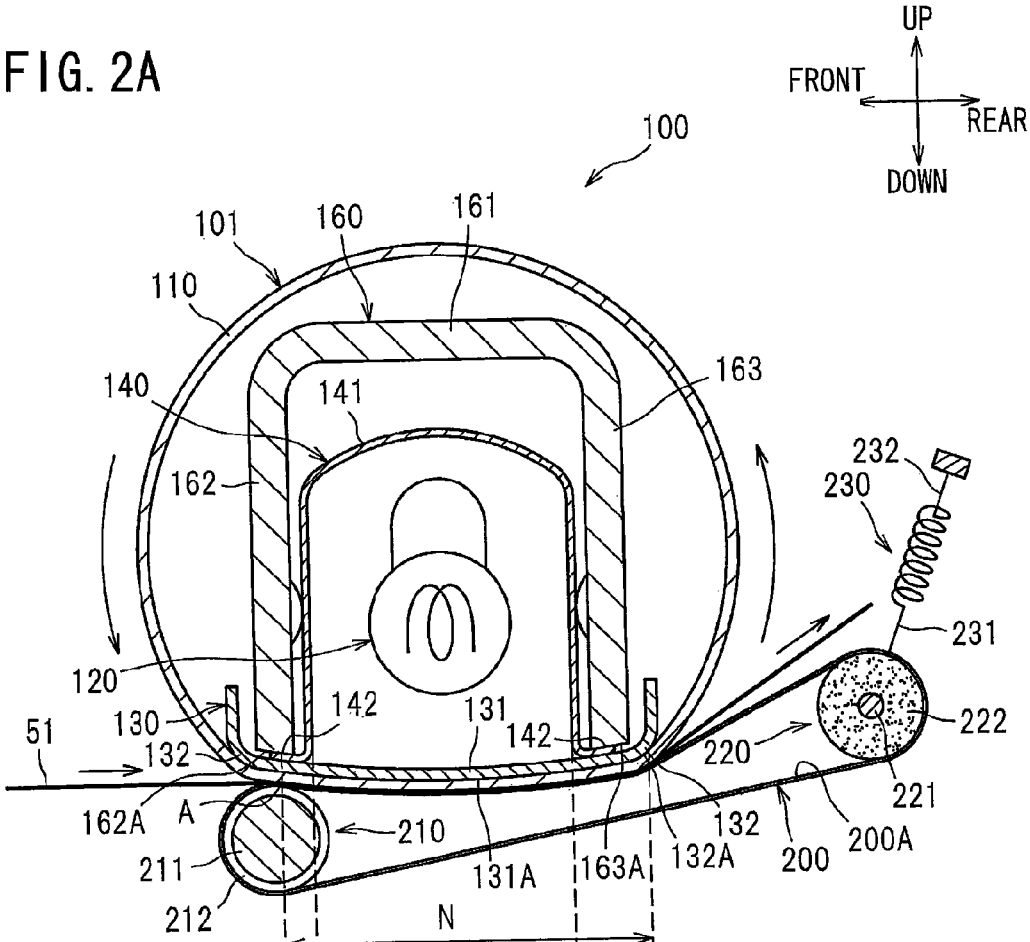
FIG. 2A is a schematic cross-sectional view of the fixing device according to the embodiment.
Figure 4:
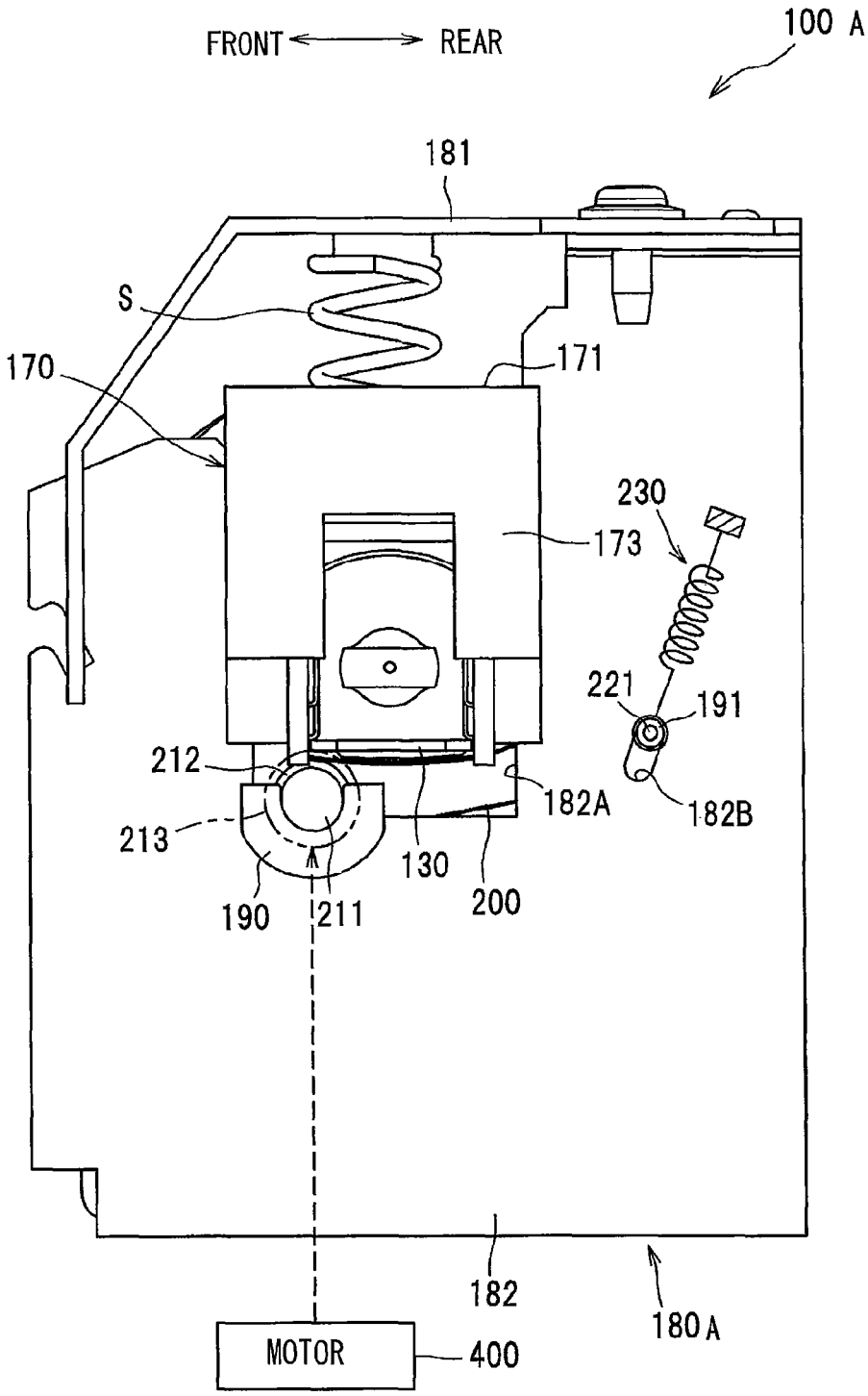
FIG. 4 is a right side view of the fixing device according to the embodiment.

As shown in FIG. 2A, the fixing device 100 includes a heater 101, a pressure belt 200, and a fixing frame 180 that supports the above components (See FIG. 4). The pressure belt 200 will be described later.

Figure 3A:
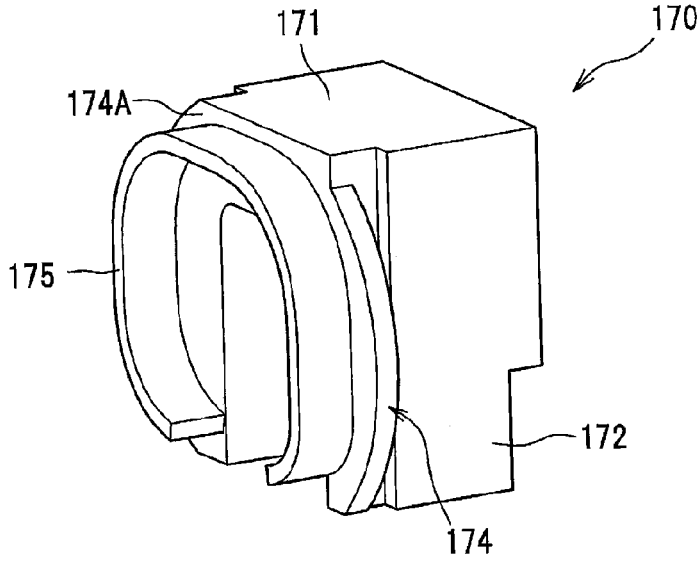
FIG. 3A is a perspective view, as viewed from above, of a regulating member in the fixing device according to the embodiment.

The heater 101 includes a fusing belt 110, a halogen lamp 120, a nip plate 130, a reflection plate 140, a stay 160, and a regulating member 170 (See FIG. 3A).

The fusing belt 110 is an endless belt that has heat resistance and flexibility. The fusing belt 110 is so formed as to come in contact with the pressure belt 200 (described later) and to follow the motion of the pressure belt 200. The fusing belt 110 includes a metal element tube that is made of stainless steel or any other metal. The fusing belt 110 may include a rubber layer formed over a surface of the metal element tube, and may further include a nonmetallic release layer such as fluorine coating formed over a surface of the rubber layer. Incidentally, the fusing belt 110 of the present embodiment follows only the motion of the pressure belt 200, and is not driven by other members.

The halogen lamp 120 is a heating element that heats the toner on the sheet 51 by heating the nip plate 130 and the fusing belt 110. On the internal space of the fusing belt 110, the halogen lamp 120 is disposed away from the inner surface of the fusing belt 110 and nip plate 130 by predetermined intervals.

The nip plate 130 is a plate-like member that receives radiation heat from the halogen lamp 120. The fusing belt 110 is nipped between the pressure belt 200 and the nip plate 130. The nip plate 130 conveys the radiation heat received from the halogen lamp 120 to the toner on the sheet 51 via the fusing belt 110.

The nip plate 130 has a generally U-shaped cross-section and is made from a material such as aluminum having a thermal conductivity higher than that of the stay 160 (described later) made from steel. More specifically, for fabricating the nip plate 130, an aluminum plate is bent into substantially U-shape to provide a base section 131 and bent sections 132. When viewed in cross-section, the base section 131 extends in the frontward/rearward direction (or direction in which the pressure belt 200 moves), and the bent sections 132 are bent upward from both ends of the base section 131. The bottom of the base section 131 provides a base surface 131A in contact with the pressure belt 200, and each bent section 132 has a bent surface 132A in contact with the pressure belt 200. Each bent surface 132A has a radius of curvature smaller than that of the base surface 131A.

The reflection plate 140 is adapted to reflect radiant heat from the halogen lamp 120 (most of the radiant heat is emitted in the frontward/rearward direction and in an upward direction) toward the nip plate 130 (an inner surface of the base section 131). As shown in FIG. 2, the reflection plate 140 is positioned in the internal space of the fusing belt 110 and surrounds the halogen lamp 120 with a predetermined distance therefrom.

Thus, radiant heat from the halogen lamp 120 can be efficiently concentrated onto the nip plate 130 to promptly heat the nip plate 130 and the fusing belt 110.

The reflection plate 140 has a substantially U-shaped cross-section and is made from a material such as aluminum having high reflection ratio regarding infrared rays or far infrared rays. The reflection plate 140 has a substantially U-shaped reflection portion 141 and a flange sections 142 extending outward from each end portion of the reflection portion 141 in the frontward/rearward direction. A mirror surface finishing is applicable on the surface of the reflection portion in order to enhance the heat reflection ratio of the reflection plate 140.

The stay 160 is a member that ensures rigidity of the nip plate 130 by supporting both ends of the base section 131 of the nip plate 130 in the frontward/rearward direction through the flange sections 142 of the reflection plate 140. The stay 160 is placed opposite to the pressure belt 200 with respect to the nip plate 130. The stay 160 has a substantially U-shaped cross-section, including an upper wall 161, a front wall 162, and a rear wall 163. The front wall 162 extends downward from the front end of the upper wall 161, and the rear wall 163 extends downward from the rear end of the upper wall 161. The stay 160 is so disposed as to cover the reflection plate 140. The stay 160 is formed by bending a steel plate or any other plate having high rigidity into a U-shape.

Figure 3B:
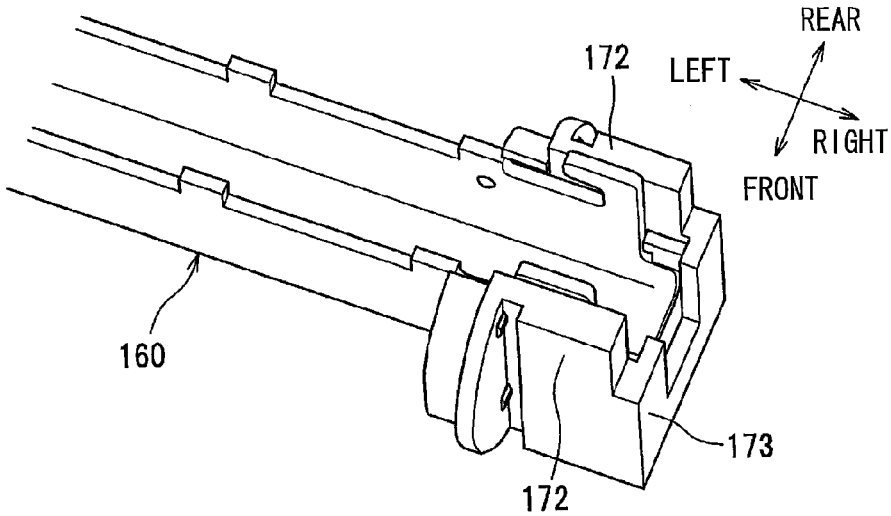
FIG. 3B is a perspective view, as viewed from below, of the regulating member and a stay assembled therewith in the fixing device according to the embodiment.
Figure 3C:
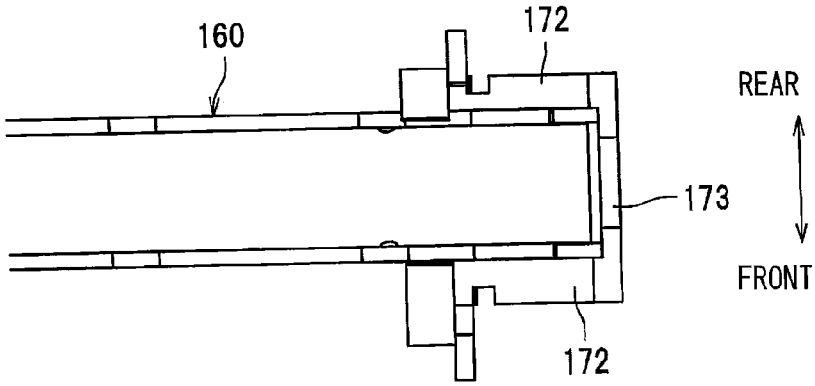
FIG. 3C is a bottom view of the regulating member and the stay assembled therewith in the fixing device according to the embodiment.

The stay 160 holds the nip plate 130 and the reflection plate 140 at a lower surface 162A of the front wall 162 and at a lower surface 163A of the rear wall 163. The stay 160 and the halogen lamp 120 are fixed to the left and the right regulating members 170 as shown in FIGS. 3A, 3B, and 3C. Alternatively, the halogen lamp 120 can be fixed to the fixing frame 180.

Each of the regulating members 170 is disposed at each of the widthwise end portions of the fusing belt 110 for regulating the movement of the fusing belt 110 in the leftward/rightward direction. Incidentally, in the following description, only the right regulating member 170 will be described, because the left regulating member 170 has the structure the same as the right regulation member.

More specifically, the regulating member 170 includes an upper wall 171, a pair of side walls 172, and a holding wall 173. The side walls 172 extend downward from both the front and the rear end portions of the upper wall 171, and the holding wall 173 extends downward from an outer end portion of the upper wall 171 in the rightward/leftward direction. The regulating member 170 holds the stay 160 so that the upper wall 171, the pair of side walls 172, and the holding wall 173 surround the stay 160.

Moreover, the regulating member 170 includes a belt regulating section 174, and a guide portion 175. The belt regulating section 174 is arcuate shaped that protrudes outward in the frontward/rearward direction from inner end portions of the pair of side walls 172 in the frontward/rearward direction. The belt regulating section 174 includes a belt regulating surface 174A at an inner side in the leftward/rightward direction for restricting movement of the fusing belt 110 in the leftward/rightward direction.

The guide portion 175 is a rib protruding inward from the belt regulating surface 174A in the leftward/rightward direction. The guide portion 175 has a C-shaped section with an opening at its lower side. The guide portion 175 is adapted to extend into the fusing belt 110 to suppress radially inward deformation of the fusing belt 110. Incidentally, the shape of the regulating member 170 is not limited to the shape described above, but the regulating member 170 can be formed into any shape.

As shown in FIG. 4, the regulating member 170 is supported by the fixing frame 180 so as to be movable in a vertical direction. The fixing frame 180 includes an upper frame 181 and a lower frame 182. On the upper frame 181, a coil spring S is provided so as to urge the regulating member 170 downward. Since the coil spring S urges the upper wall 171 of the regulating member 170 downward, a suitable nip pressure can be applied between the nip plate 130 and the pressure belt 200.

Substantially U-shaped support grooves 182A is formed on each of the left and right walls of the lower frame 182 for supporting the regulating member 170 so that the regulating member 170 is movable in the vertical direction. A bearing 190 for supporting a first shaft 211 of a first roller 210 (described later), is provided on the front side of the bottom portion of the support groove 182A. The lower frame 182 is formed with an elongated slot 182B at a position rearward of the support grooves 182A. The elongated slot 182B is adapted to support a bearing 191 so that the bearing 191 can move in an obliquely-upward/downward direction. The bearing 191 rotatably supports a second shaft 221 of a second roller 220, which will be described later.

<Configuration of Pressure Belt>

As shown in FIG. 2A, the pressure belt 200 is an endless belt that faces the fusing belt 110 and is in contact with the fusing belt 110, thereby forming a nip region N. A portion of the pressure belt 200 that faces the fusing belt 110 is so configured as to move rearward.

The pressure belt 200 is made from a resin such as polyimide resin. An inner peripheral surface 200A of the pressure belt 200 is supported by the first roller 210 and the second roller 220. Incidentally, all that is required for the pressure belt 200 is to contain resin.

The first roller 210 faces the fusing belt 110. The pressure belt 200 is held between the first roller 210 and the fusing belt 110. The pressure belt 200 and the fusing belt 110 are held between the first roller 210 and the front side of the base surface 131A in which the front side is an upstream side of the base surface 131A in the running direction of the pressure belt 200.

More specifically, the first roller 210 is disposed at a position where the lower surface 162A supports the base section 131, or is aligned with the front wall 162 in the frontward/rearward direction. The nip plate 130, the pressure belt 200, and the fusing belt 110 are held between the first roller 210 and the lower surface 162A of the stay 160. Incidentally, according to the present embodiment, only the first roller 210 nips the pressure belt 200 in cooperation with the fusing belt 110.

As shown in FIG. 4, the first roller 210 is coupled to a first gear 213, which is driven by a motor 400 disposed outside. The first roller 210 includes a first shaft 211 and a first elastic layer 212 formed over an outer peripheral surface of the first shaft 211 and made from a rubber. More specifically, when considering the section of the first roller 210, the first elastic layer 212 has a thickness smaller than that of a second elastic layer 222, which will be described later. Therefore, compared to a structure in which the thickness of the first elastic layer is equal to the thickness of the second elastic layer, the first elastic layer 212 is less compressed when the pressure belt 200 is nipped between the first roller 210 and the nip plate 130. Accordingly, sufficient pressing force of the first roller 210 can be provided.

Incidentally, the thickness of the first elastic layer 212 of the first roller 210 can be, for example, not more than half the radius of the first shaft 211. The thickness of the first elastic layer 212 may be in the range of 0.01 to 10.00 mm, or in the range of 0.1 to 5.00 mm, or in the range of 0.15 to 3.00 mm. The thickness of the second elastic layer 222 of the second roller 220 may be in the range of 0.10 to 40.00 mm, or in the range of 2.0 to 20.00 mm, or in the range of 5.00 to 15.00 mm.

As shown in FIG. 2A, the second roller 220 includes the second shaft 221 and the second elastic layer 222 formed over an outer peripheral surface of the second shaft 221 and made from a thermal insulation material such as foamable sponge material. The second roller 220 is driven by the first roller 210.

The second roller 220 is positioned rearward of the first roller 210 and the nip region N (downstream of the first roller 210 and the nip region N in the running direction of the pressure belt 200). Further, the second roller 220 supports the pressure belt 200 at a position higher than a position A at which the first roller 210 and the fusing belt 110 nip the pressure belt 200 therebetween (the position A is an upstream end position of the nip region in the running direction of the pressure belt 200). Incidentally, the position of the second roller 220 suffices the requirement as long as at least a portion of the second roller 220 is located higher than the position A, A coil spring 230 is connected to the second roller 220 for urging the second roller 220 in an obliquely-upward direction, i.e. in rearward and diagonally upward direction. The coil spring 230 has a lower end section 231 engaged with the bearing 191 (See FIG. 4) which rotatably supports the second shaft 221 of the second roller 220, and has an upper end section 232 engaged with the main frame 2 or the fixing frame 180. Incidentally, urging direction of the coil spring 230 is not limited to the obliquely-upward direction, but can be any direction as long as the direction contains a component of the upward direction defined as the direction from the first roller 210 to the heater 101.

Since the second roller 220 is positioned higher than the position A, the pressure belt 200 can contact the fusing belt 110 in a region extending from the position where the lower surface 162A supports the nip plate 130, i.e. from the front end of the base surface 131A, to the bent surface 132A. That is, within the region, the nip region N is defined. Therefore, an elongated nip region N can be provided.

Within the nip region N, the reflection portion 141 is overlapped with a heated region of the nip plate 130 receiving radiation heat from the halogen lamp 120. When viewed in the vertical direction, the heated region is at a position that does not overlap with the position A where the pressure belt 200 is nipped between the first roller 210 and the fusing belt 110, i.e. the heated region is positioned rearward of the position A. Alternatively, the position A can be included in the region where the nip plate 130 receives radiation heat from the halogen lamp 120, when viewed in the vertical direction. For example, the position A can be placed forward of the center of the region in the frontward/rearward direction.

Figure 5A:
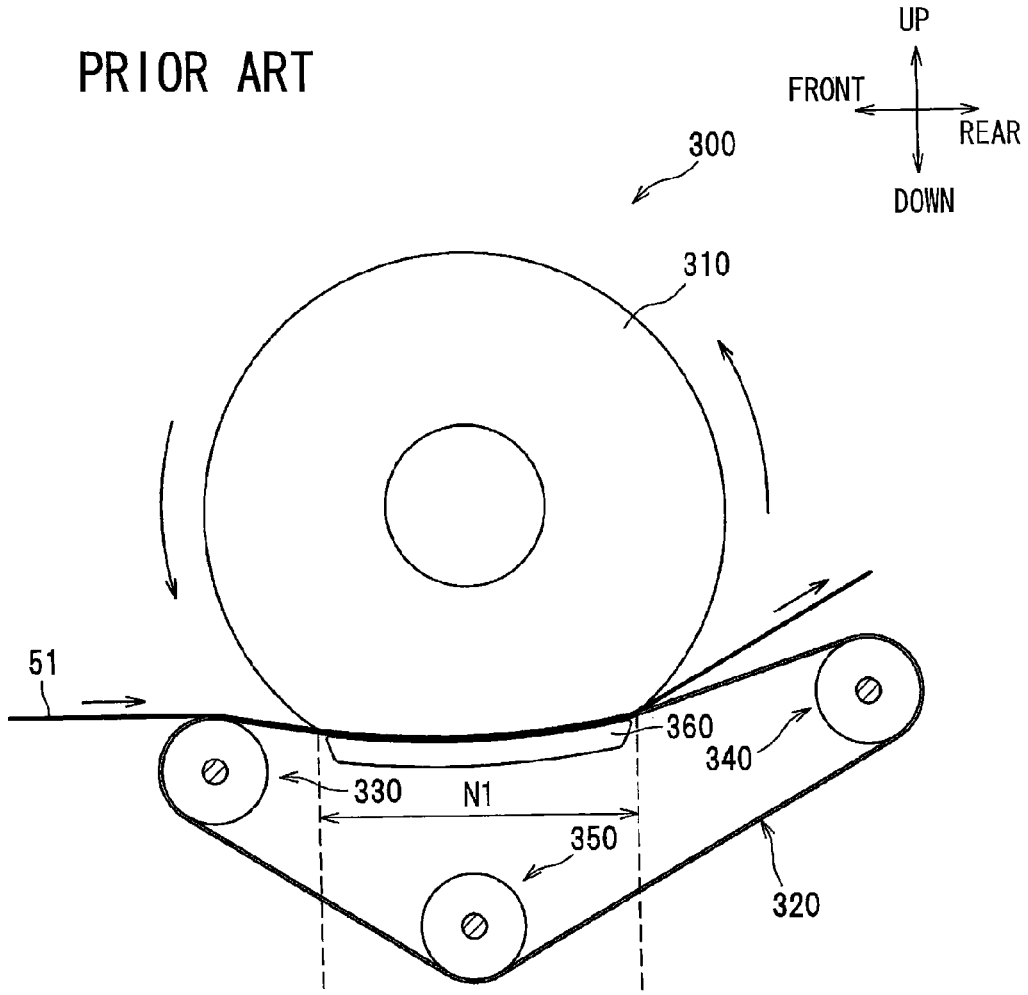
FIG. 5A PRIOR ART
FIG. 5A is a cross-sectional view of a fixing device according to a comparative example.

With the construction described above, the nip region N is provided between the pressure belt 200 and the heater 101. Here, comparative tests were carried out for demonstrating superiority of the fixing device according to the present embodiment in comparison with a comparative example according to the fixing device described in Japanese Patent Application Publication No. 2010-256696 shown FIG. 5A. The comparative example includes a heating roller 310, a pressure belt 320, and a pressure pad 360. The pressure belt 320 forms a nip region N1 between the pressure belt 320 and the heating roller 310. The pressure pad 360 holds the pressure belt 320 between the pressure pad 360 and the heating roller 310. The pressure belt 320 is stretched around a front roller 330 positioned frontward of the heating roller 310, a rear roller 340 positioned rearward of the heating roller 310, and a central roller 350. The central roller 350 is positioned between the front roller 330 and the rear roller 340, and is away from an area where the heating roller 310 is in contact with the pressure belt 320.

Figure 5B:
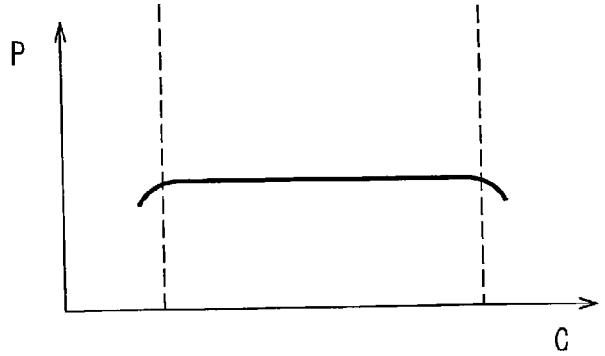
FIG. 5B is a graph indicating a distribution of a contact pressure P at a contact position C between a heating device and a fusing belt in a frontward/rearward direction in the fixing device according to the comparative example.

According to the comparative example, the nip region N1 is formed in the range where the pressure belt 320 is nipped between the heating roller 310 and the pressure pad 360. In the range of the nip region N1, the pressure belt 320 is pressed by the pressure pad 360 against the heating roller 310. FIG. 5 B is a graphical representation showing a relationship between a contact pressure P between the heating roller 310 and the pressure belt 320 and a contact position C between the pressure belt 320 and the heating roller 310. As shown in FIG. 5B, the contact pressure P is substantially uniform in the frontward/rearward direction along the contact area.

In the comparative example, if the contact pressure between the heating roller 310 and the pressure belt 320 is to be further increased at an entry position of the sheet 51, pressing force applied to the entire nip region N1 needs to be increased. As a result, the entire fixing device is subjected to larger load, which renders the structure of the fixing device more complex.

On the other hand, according to the present embodiment, as shown in FIG. 2A, the first roller 210 faces the fusing belt 110 supported by the nip plate 130, so that the pressure belt 200 is nipped between the first roller 210 and the fusing belt 110. In addition, the second roller 220 supports the pressure belt 200 at a position rearward of the nip region N. Therefore, the pressure belt 200 can be urged by the first roller 210 against the fusing belt 110 supported by the nip plate 130.

Figure 2B:
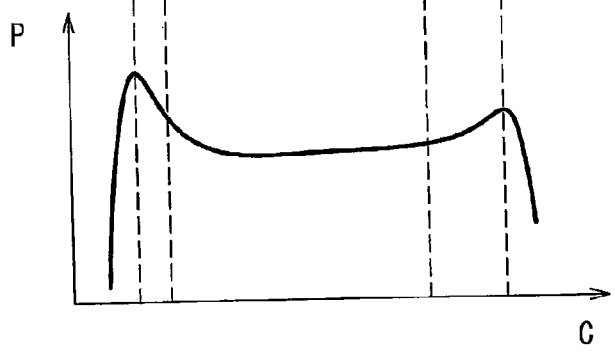
FIG. 2B is a graph indicating a distribution of a contact pressure P at a contact position C between a heating device and a fusing belt in a frontward/rearward direction.

Accordingly, as shown in FIG. 2B, the contact pressure between the pressure belt 200 and the fusing belt 110 at the position of the first roller 210, i.e. at the entry position of the sheet 51, can be increased, thereby preventing the sheet 51 from being slipped relative to the pressure belt 200 at the entry position of the sheet 51. As a result, a failure of sheet entry can be prevented. Moreover, only the first roller 210 is pressed against the pressure belt 200. Therefore, the pressing force of the entire nip region N does not have to be increased. Consequently, in comparison with the comparative example, the simplified structure of the entire fixing device 100 can be provided.

Further, the second roller 220 supports the pressure belt 200 at the position higher than the position A where the pressure belt 200 is nipped between the first roller 210 and the fusing belt 110. Therefore, the pressure belt 200 can be pressed upward when the pressure belt 200 comes in contact with the fusing belt 110 supported by the nip plate 130. Therefore, as shown in FIG. 2B, the contact pressure P between the pressure belt 200 and the heater 101 behind the first roller 210 can be increased.

Further, the second roller 220 supports the pressure belt 200 at a position rearward of the nip region N. Therefore, the second roller 220 is unlikely to absorb heat from the nip region N.

Further, the coil spring 230 pulls the second roller 220 in the rearward and obliquely-upward direction. Therefore, the pressure belt 200 can be pulled rearward and obliquely-upward direction, so that sufficient tension of the pressure belt 200 can be maintained.

Further, a rear end portion of the nip region N is defined by the bent surface 132A, which is part of the rear bent section 132 of the nip plate 130. Therefore, the pressure belt 200 can be pressed against the rear bent surface 132A whose radius of curvature is smaller than that of the base surface 131A of the base section 131. Thus, as shown in FIG. 2B, the contact pressure between the pressure belt 200 and the fusing belt 110 can be increased at the rear end portion of the nip region N. Consequently, the sheet 51 can be properly discharged from the nip region N.

Further, the nip plate 130, the pressure belt 200, and the fusing belt 110 are nipped between the first roller 210 and the lower surface 162A. Therefore, the contact pressure between the pressure belt 200 and the fusing belt 110 can be increased at the position of the first roller 210.

Further, if the first roller 210 is located at a position corresponding to the front bent section 132 having a smaller curvature radius than the base section 131 of the nip plate 130, and if the heater 101 becomes inclined, a contacting state between the pressure belt 200 and the fusing belt 110 may be unstable at the position of the first roller 210.

On the other hand, according to the present embodiment, the pressure belt 200 and the fusing belt 110 are nipped between the first roller 210 and the base surface 131A having the radius of curvature greater than that of the bent sections 132. Therefore, the pressure belt 200 can be appropriately in contact with the heater 101 at the position of the first roller 210 regardless of accidental inclination of the heater 191.

Further, the first shaft 211 made from metal can increase the contact pressure between the heater 101 and the first roller 210. In addition, the first elastic layer 212 is formed over the surface of the first shaft 211, thereby keeping gripping force against the pressure belt 200 while maintaining high contact pressure between the heater 101 and the first roller 210.

If the pressure belt is made from metal, the pressure belt may absorb heat from the heater, because the metal has high thermal conductivity. In contrast, according to the present embodiment, the pressure belt 200 is made from resin, thereby keeping low thermal conductivity of the pressure belt 200. Consequently, the pressure belt 200 made from resin can restrain heat removal from the heater 101 while maintaining durability.

Further, the second roller 220 has the second elastic layer 222 as an outer layer, and the elastic layer has heat insulation characteristics. Therefore, the second roller 220 is unlikely to absorb heat from the pressure belt 200. As a result, the pressure belt 200 is unlikely to absorb heat from the heater 101.

Further, the nip region N can have an enlarged area, resulting in an improvement in heating efficiency in the nip region N.

A fixing device 100' according to a modified embodiment of the present invention will be described with reference to FIGS. 6 and 7. According to the above-described embodiment, the second roller 220 is pulled by the coil spring 230. However, the present invention is not limited to this configuration, but a second roller 220 may not have to be pulled by a coil spring.

Figure 6:
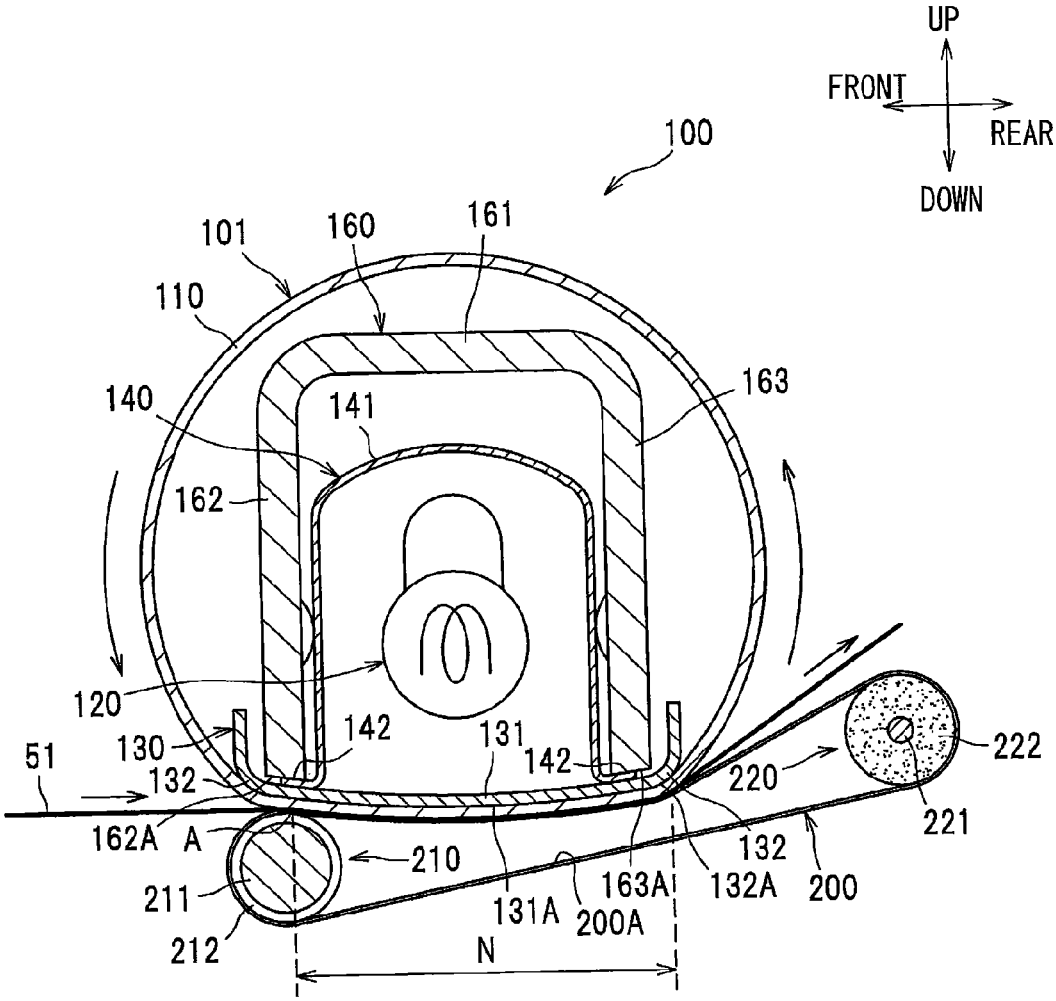
FIG. 6 is a cross-sectional view of a fixing device according to a modified embodiment of the present invention.
Figure 7:
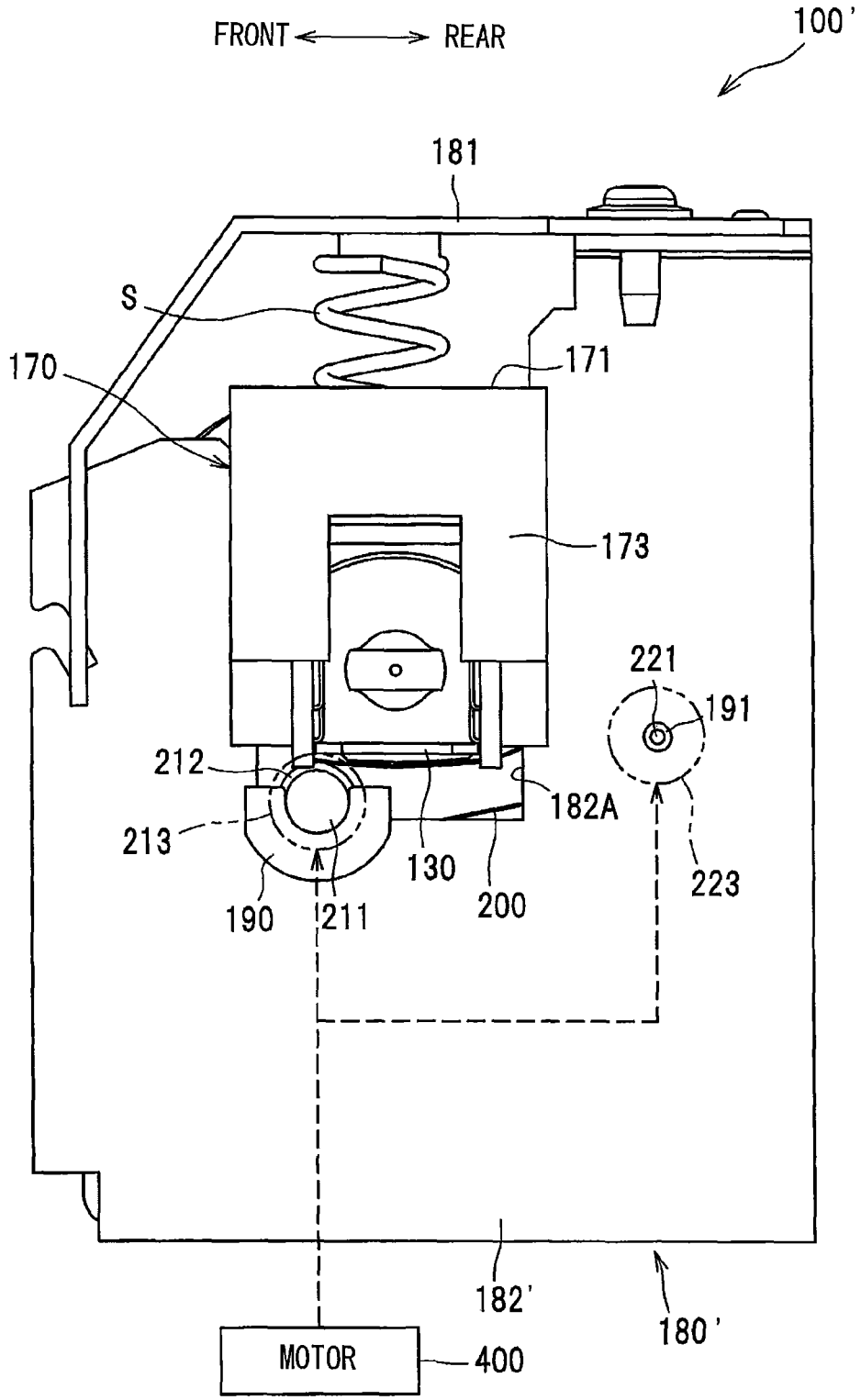
FIG. 7 is a right side view of the fixing device according to the modification.

As shown in FIG. 6, a pressure belt 200 faces a fusing belt 110 in a manner the same as the above-described embodiment in which a nip region N is provided between the pressure belt 200 and the fusing belt 110. Further, as shown in FIG. 7, a second roller 220 is positioned behind a support groove 182A of a lower frame 182' of a fixing frame 180'. A bearing 191 is supported to the lower frame 182', and a second shaft 221 is rotatably supported by the bearing 191. With this structure, the pressure belt 200 can be nipped between a first roller 210 and a nip plate 130. Therefore, the contact pressure between the pressure belt 200 and the fusing belt 110 can be increased.

Further, the second roller 220 is coupled with a second gear 223 which is driven by a motor 400 disposed outside of the fixing device 100'. Here, the circumferential velocity of the second roller 220 is set to be higher than that of the first roller 210. In this manner, the rotation of the second roller 220 pulls an upper portion of the pressure belt 200 rearward. As a result, sufficient tension can be applied to an upper portion of the pressure belt 200, or to a portion of the pressure belt 200 in contact with the fusing belt 110. Incidentally, the second roller 220 can receive a drive force directly or indirectly from the motor 400.

According to the above-described embodiment, the first roller 210 is disposed at a position where the nip plate 130 is nipped between the first roller 210 and the lower surface 162A. However, the first roller 210 may not need to be placed at that position.

Further, according to the above-described embodiment, the two rollers, the first and second rollers 210 and 220, support the inner peripheral surface of the pressure belt 200. However, the present invention is not limited to this configuration. For example, three or more rollers can be used for supporting the pressure belt.

Further, according to the above-described embodiment, the heater 101 includes the fusing belt 110 and the nip plate 130. Instead, a heating roller is available as the heater.

Further, according to the above-described embodiment, the first roller 210 is driven by the motor 400 disposed outside of the fixing device 100. However, the motor for driving the first roller 210 is not required, if the heater is a heating roller and if the rotation force is imparted on heating roller. In addition, the first roller may not have to be driven by a motor, if driving force is directly imparted on the second roller and provided that slippage of the pressure belt relative to the first roller does not occur.

Further, according to the above-described embodiment, the first elastic layer 212 is formed over the metallic first shaft 211 in the first roller 210. However, the elastic layer can be dispensed with. Alternatively, a metallic layer and an elastic layer can be formed over a non-metallic shaft member to provide the first roller.

Further, according to the above-described embodiment, the second roller 220 includes as an outer layer the second elastic layer 222 made from thermally insulating material. However, an elastic layer with no heat insulating characteristic is available as the outer layer.

Further, according to the above-described embodiment, the pressure belt 200 is made from resin. Instead, the pressure belt 200 can be made from metal.

Further, the above-described embodiment is applied to the color laser printer 1. However, the present invention is also available to an image formation device other than color laser printer, such as a monochromatic printer, a copying machine and a multifunction device.

While the invention has been described in detail and with reference to specific embodiment thereof, it would be apparent to those skilled in the art that various changes and modifications can be made without departing from the spirit and scope of the invention.

What is claimed is:

1. A fixing device, comprising:

a heater;

a first endless belt confronting the heater at a confronting part and providing a nip region upon contacting the heater, the first endless belt being movable in a first direction at the confronting part, and having an inner peripheral surface;

a first roller supporting the inner peripheral surface, and nipping the first endless belt in cooperation with the heater, the nip region having a part facing the first roller; and a second roller disposed downstream of the nip region in the first direction and supporting the inner peripheral surface, the second roller being positioned such that a part of the first endless belt mounted over the second roller is out of contact from the heater, assuming that the heater is positioned above the first roller, the second roller having a part positioned higher than the first roller.

2. The fixing device according to claim 1, further comprising an urging member that urges the second roller in a second direction from the first roller to the heater.

3. The fixing device according to claim 2, wherein the urging member also urges the second roller in the first direction.

4. The fixing device according to claim 1, further comprising a first receiving member configured to receive an external driving force and coupled to the first roller for driving the first roller; and wherein the heater comprises a second endless belt configured to make contact with and be driven by the first endless belt.

5. The fixing device according to claim 4, further comprising a second receiving member configured to receive the external driving force and coupled to the second roller for driving the second roller, the second roller providing a circumferential velocity higher than that of the first roller.

6. The fixing device according to claim 1, wherein the heater comprises a second endless belt in contact with the first endless belt and to be driven by the first endless belt, and a nip member configured to nip the second endless belt between the first endless belt and the nip member, the nip member having a first surface and a second surface constituting the nip region, the second surface being positioned downstream of the first surface in the first direction and having a radius of curvature smaller than that of the first surface.

7. The fixing device according to claim 6, wherein the nip member is formed into a plate shape.

8. The fixing device according to claim 6, further comprising a stay positioned opposite to the first endless belt with respect to the nip member and having a supporting surface for supporting the nip member, the first roller being configured to nip the nip member, the first endless belt, and the second endless belt in cooperation with the supporting surface.

9. The fixing device according to claim 6, wherein the first roller is configured to nip the first endless belt and the second endless belt in cooperation with the first surface.

10. The fixing device according to claim 1, wherein the first roller comprises a first metallic part, and a first elastic layer formed over the first metallic part.

11. The fixing device according to claim 1, wherein the first endless belt is made from resin.

12. The fixing device according to claim 1, wherein the second roller comprises an elastically deformable and thermally insulating layer as an outer layer.

13. The fixing device according to claim 1, wherein the first roller comprises a first metallic part and a first elastic layer formed over the first metallic part; and wherein the second roller comprises a second metallic part and a second elastic layer formed over the second metallic part, the second elastic layer having a thickness greater than that of the first elastic layer.

14. The fixing device according to claim 13, wherein the first elastic layer is a rubber layer, and the second elastic layer is an elastic foamable layer.

15. A fixing device, comprising:

a first roller;

a second roller;

a first endless belt arranged around the first roller and the second roller; and a heater configured to nip the first endless belt in cooperation with the first roller, and to provide a nip region upon contacting the first endless belt, a width of the nip region in a direction from the first roller toward the second roller being narrower than a distance between the first roller and the second roller.

16. The fixing device according to claim 15, further comprising a first receiving member configured to receive an external driving force and coupled to the first roller for driving the first roller; and wherein the heater comprises a second endless belt configured to make contact with and be driven by the first endless belt.

17. The fixing device according to claim 16, further comprising a second receiving member configured to receive the external driving force and coupled to the second roller for driving the second roller, the second roller providing a circumferential velocity higher than that of the first roller.

18. The fixing device according to claim 15, wherein the heater comprises a second endless belt in contact with the first endless belt and to be driven by the first endless belt, and a nip member configured to nip the second endless belt between the first endless belt and the nip member, the nip member having a first surface and a second surface constituting the nip region, the second surface being positioned downstream of the first surface and having a radius of curvature smaller than that of the first surface.

19. The fixing device according to claim 18, wherein the nip member is formed into a plate shape.

20. The fixing device according to claim 18, further comprising a stay positioned opposite to the first endless belt with respect to the nip member and having a supporting surface for supporting the nip member, the first roller being configured to nip the nip member, the first endless belt, and the second endless belt in cooperation with the supporting surface.

21. The fixing device according to claim 18, wherein the first roller is configured to nip the first endless belt and the second endless belt in cooperation with the first surface.

22. The fixing device according to claim 15, wherein the first roller comprises a first metallic part, and a first elastic layer formed over the first metallic part.

23. The fixing device according to claim 15, wherein the first endless belt is made from resin.

24. The fixing device according to claim 15, wherein the second roller comprises an elastically deformable and thermally insulated layer as an outer layer.

25. The fixing device according to claim 15, wherein the first roller comprises a first metallic part and a first elastic layer formed over the first metallic part; and wherein the second roller comprises a second metallic part and a second elastic layer formed over the second metallic part, the second elastic layer having a thickness greater than that of the first elastic layer.

26. The fixing device according to claim 25, wherein the first elastic layer is a rubber layer, and the second elastic layer is an elastic foamable layer.

* * * * *